US005520110A

United States Patent [19]

Tittgemeyer

[11] Patent Number: 5,520,110

[45] Date of Patent: May 28, 1996

[54] PROCESS AND DEVICE FOR FILLING DEPRESSIONS, SUCH AS CUPS OR CHANNELS, ON THE CYLINDRICAL SURFACE OF A ROTATING CYLINDRICAL BODY

[75] Inventor: Udo Tittgemeyer, Arnsberg, Germany

[73] Assignee: MAN Roland Druckmaschinen AG, Offenbach am Main, Germany

[21] Appl. No.: 372,140

[22] Filed: Jan. 13, 1995

[30] Foreign Application Priority Data

Jan. 18, 1994 [DE] Germany ..... 44 01 332.9

[51] Int. Cl.[6] ..... B41F 31/06; B41F 31/08

[52] U.S. Cl. ..... 101/363; 101/483

[58] Field of Search ..... 101/147, 148, 101/350, 351, 356, 363, 365, 366, 207–210, 483

[56] References Cited

U.S. PATENT DOCUMENTS

| | | | |
|---|---|---|---|
| 2,399,688 | 5/1946 | Metzner et al. | 101/364 |
| 3,400,658 | 9/1968 | Gagliardi et al. | 101/366 |
| 3,457,858 | 7/1969 | Gibbs | 101/363 |
| 3,730,089 | 5/1973 | McCutcheon | 101/363 |
| 4,085,672 | 4/1978 | Grosart | 101/169 |
| 4,158,333 | 6/1979 | Navi | 101/363 |
| 4,590,855 | 5/1986 | Schommer et al. | 101/157 |
| 4,958,561 | 9/1990 | Grosshauser et al. | 101/363 |
| 5,406,887 | 4/1995 | Hertel et al. | 101/366 |

FOREIGN PATENT DOCUMENTS

| | | |
|---|---|---|
| 0114329 | 8/1984 | European Pat. Off. . |
| 0315091 | 5/1989 | European Pat. Off. . |
| 0324140 | 7/1989 | European Pat. Off. . |
| 2054464 | 2/1991 | European Pat. Off. . |
| 2264119 | 7/1974 | Germany . |
| 3025291 | 1/1982 | Germany . |
| 3843017 | 5/1990 | Germany . |
| 3911839 | 10/1990 | Germany . |
| 4001733 | 7/1991 | Germany . |
| 9216754 | 3/1993 | Germany . |

*Primary Examiner*—J. Reed Fisher

*Attorney, Agent, or Firm*—Cohen, Pontani, Lieberman, Pavane

[57] ABSTRACT

A process and a device for the filling of depressions on the cylindrical surface of a rotating, cylindrical body, wherein the device includes a chamber with an interior space having all approximately circular cross-section. Fluid is supplied and discharged centric to the cross-section so that a rotating fluid roller forms when the chamber is positioned on the rotating cylindrical body.

15 Claims, 4 Drawing Sheets

PROCESS AND DEVICE FOR FILLING DEPRESSIONS, SUCH AS CUPS OR CHANNELS, ON THE CYLINDRICAL SURFACE OF A ROTATING CYLINDRICAL BODY

BACKGROUND OF THE INVENTION

1. Field of the Invention

The invention relates to a process and a device for filling depressions, such as cups or grooves, on the cylindrical surface of a rotating, cylindrical body, such as a roller, cylinder or sleeve, with a fluid by means of a chamber located alone, the mantle of the cylindrical body and open towards the cylindrical body. Cylindrical bodies of this type can be, for example, the screen rollers of short inking units or gravure cylinders which are inked. However, use is also possible with damping or varnishing units, for example.

2. Description of the Prior Art

It is traditional in the case of gravure cylinders to use immersion inking with subsequent wiping off by means of a doctor blade (e.g., EP 0 114 329 B1). Apart from ink spraying or ink misting, this inking process is associated with ink blockage under the blade, especially during positive inking, i.e., when the doctor blade points in the rotational direction of the cylinder, because the cylinder delivers a considerably excessive quantity of ink and the new ink being constantly delivered prevents any backflow. The ink blockage causes the doctor blade to bend, and in order to compensate for this increased blade placement forces are required. These forces, in conjunction with the blocked ink, result in considerable abrasion of the type form. Furthermore, the hydrodynamic pressure of the ink blockage is dependent on the circumferential speed of the cylinder being inked, which leads to a speed-dependent knife pressure on the cylinder and thus to the known ink fluctuations as a function of speed in gravure printing. Finally, the cohesive forces of printing inks are in principle substantially greater than the adhesive forces to the typeform, for which reason, after a cup is filled, printing ink is essentially removed repeatedly from the cup surface, leading to at least a ten-percent underfilling of the cups.

Currently, the inking of anilox rollers is done with chamber blade systems in a great variety of designs on the basis of various principles. Thus, DE 92 16 754 U1 discloses a chamber blade in which both the working blade and the closing blade are placed on the screen roller negatively, i.e., opposite to the rotational direction of the screen roller, and the inking space is rectangular. In order to fill the chamber in a manner that is at least axially uniform, a higher chamber pressure burden must be ensured. However, this pressure in the chamber leads inevitably to the opening of the negatively placed closing blade and thus to an egress of ink, apart from the increased wear on the working blade. In addition, due to insufficient ink flow, ink clusters form in the chamber corners with air pockets that interfere with inking.

According to EP 0 324 140 B1, the attempt is made to achieve inking without pressure by installing a scoop roller in the chamber blade.

Other constructions, for their part, describe the necessity of built-in elements in the interior of the chamber blades. Thus, EP 0 315 091 B1 discloses an example with a blade chamber having an interior with a circular cross-section, in which there is a cylindrically shaped body which bears on and is driven by the anilox-roller. Other built-in elements of different shapes are also suggested. This design, too, is unable to ensure flawless functioning. Air necessarily makes its way into the interior space, on the one hand through the emptied cups, and on the other hand through the slip-stream on the cylinder surface. The ink that has flowed onto the screen roller in the interior space cannot freely exchange itself for air, but rather mixes with the air.

Furthermore, the ink accelerates in the gap to the built-in elements, so that relative movements take place between the ink and the cylinder surface which interfere with inking. Behind the gap created by the built-in elements, diffuse relaxation of the ink film occurs, with the result that the ink film, since it can flow off freely, has no reason to adhere to the surface up to the working blade. The ink will thus tend to flow off rather than to ensure uniform inking by collecting below the blade knife point.

DE 39 11 839 A1 discloses an inking device in which an ink application channel with an arc-shaped cross-section is located in a pressure-free washing box. This channel passes along the ink supplied via its length to a screen roller. Here, too, there are problems of air collection in the ink channel as well as problems of air influence on the path of the cups to a working blade optionally located at a distance from the ink application channel.

SUMMARY OF THE INVENTION

Accordingly, it is an object of the present invention to provide a process which, while eliminating the disadvantageous influence of air and operating at low fluid pressure, reliably fills the depressions on the cylindrical surface of a rotating cylindrical body with a fluid. In addition, a simply designed device for carrying out the process is a further object of the invention.

Pursuant to these objects, and others which will become apparent hereafter, one aspect of the present invention resides in filling the depressions with a device which has a fluid inlet and a fluid outlet, and is located on the rotating, cylindrical body. The device has an obstruction-free interior space that is closed on its end face. Due to rotation of the cylindrical body, to the axis of which the device is parallel, a rotating fluid roller is formed in the interior space which fills the depressions. Fluid is supplied to and from the center of the device, depending on a desired fluid circulation and the scoop volume of the cylindrical body, by guiding the fluid in on one side and carrying it off on another side of the device so that an overpressure is created in the interior space.

In order to fill the depressions, the invention uses a rotating fluid roller, which is formed in the correspondingly shaped interior space of a chamber positioned on the cylindrical body. The fluid roller avoids movements relative to the cylindrical body both in the circumferential and in the longitudinal directions, which is a prerequisite for flawless inking. In the longitudinal direction, there is a longitudinal flow only in the center of the fluid roller, which flow declines radially in the direction of the circumference to zero. The central flow is caused by the central supply of fluid with overpressure at one end of the fluid roller and its similarly central extraction at the other end. First of all, this achieves fluid renewal in the device; secondly, the conduction of the fluids in order to fill the cups is accomplished. An axial filling of the chambers and thus the uniform filling of the depressions across the breadth is thereby ensured. Furthermore, due to the drop in circumferential speed toward the center, any air dragged into the chamber is collected in the center of the fluid roller. There, the air does not interfere with inking and can, in addition, due to the prevailing longitudinal flow in the center, be discharged. Faulty filling, known as "missing dots", are thus prevented.

The rotation of the fluid roller is initiated by the rotating cylindrical body. The latter acts in principle like a vane-cell pump, i.e., the rotating cylindrical body delivers the fluid within the chamber and circulates it. In keeping with the large surface of the rotating cylindrical body, its cup volume and its circumferential speed, this delivery of ink is a multiple of the ink consumption and many times what an ink supply pump would have to provide. Reliable filling of the depressions is ensured regardless of the speed of the cylindrical body, because the inner circulatory flow speed is independent of the ink supply, including its pressure. In one embodiment, the circumferential flow of the fluid roller is also advantageously conducted along the breadth of a doctor blade, so that no blockage pressure occurs there and the blade knife pressure does not have to be adjusted in the event of changes in speed, in either negative or positive positioning. Since the liquid does not become blocked, apart from its meeting on the blade point, the device operates at only a low inner pressure, so that overall wear on the blades as well as on the cylindrical body is slight. At the same time, the overpressure, in the manner of a control loop, provides for the pressure on the working blade and the closing blade.

The device according to the invention is simply designed and thus economical to produce. In addition, the device is compact, so that flawless inking call be ensured at the smallest possible chamber volume regardless of the speed of the cylindrical body, because the inner circulatory flow speed and the fluid supply with pressure are independent of one another. Thus, reliable filling of the depressions is ensured even in a chamber with an interior space diameter of 5 cm and a length of 260 cm. The low volume of the chamber is also of advantage during an ink change.

In another embodiment of the invention, a working blade is connected to the chamber so as to close the interior space in the rotational direction of the cylindrical body. The working blade is positionable against the cylindrical body.

In yet another embodiment, the working blade is arranged negatively or positively relative to the cylindrical body. A blade holder is provided to hold the working blade against the chamber body.

In yet a further embodiment, the blade holder is swingable and slidably adjustable relative to the cylindrical body.

In still another embodiment a blade table is attached to the chamber member. The table has a U-shaped receptacle with a yoke and the chamber member is held against the yoke by working cylinders.

A further embodiment of the invention provides a pump for producing an overpressure in a range of 0.1–1.5 bar in the interior space of the chamber member. The pump is attached to a fluid inlet of the chamber member.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
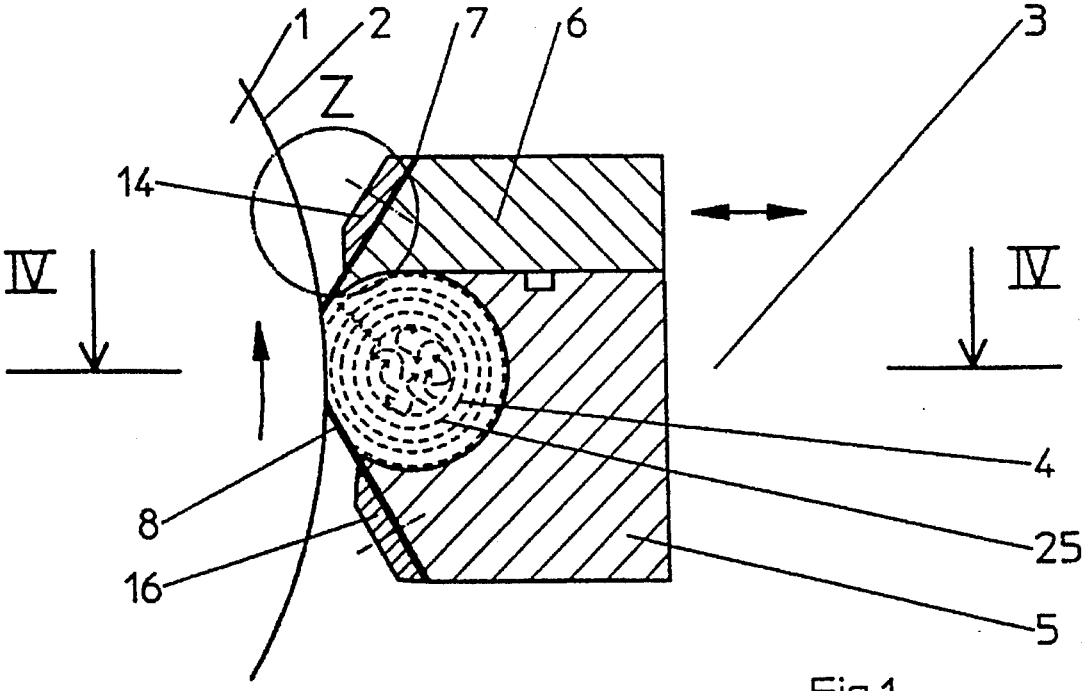
FIG. 1 is a cross-section of a device for inking a screen roller, with a negatively positioned working blade.
Figure 4:
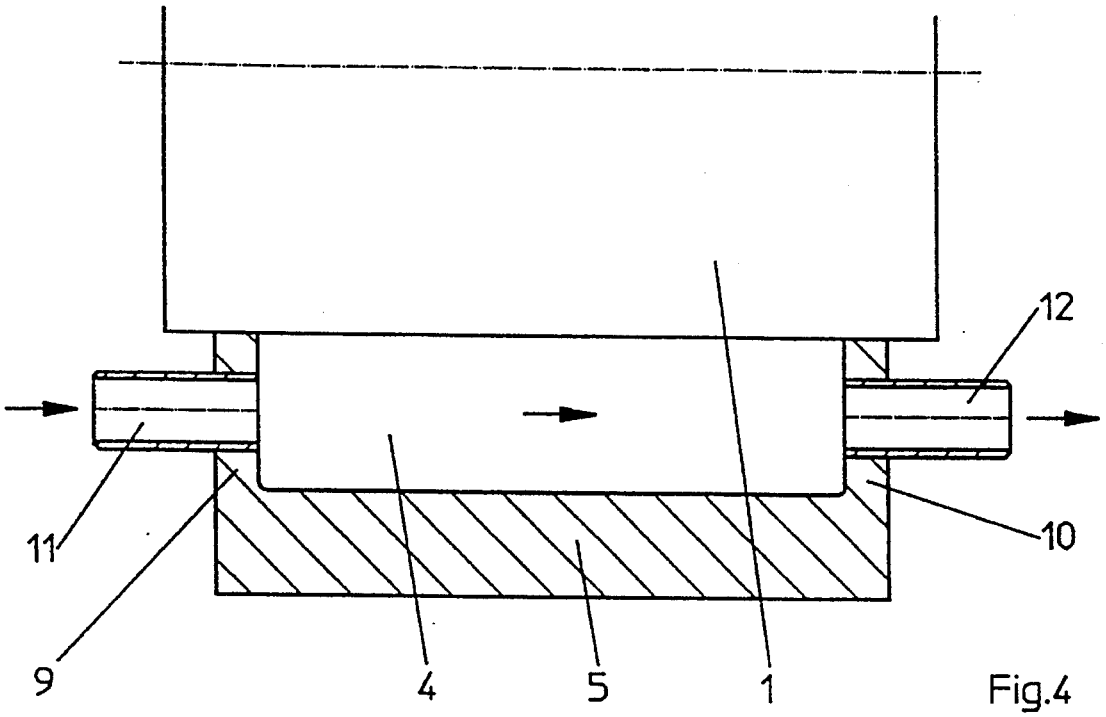
FIG. 4 is a Section IV—IV of FIG. 1.

In FIG. 1, a device for filling depressions is positioned on a gravure form cylinder 1. The device consists of a chamber 3 arranged along the mantle 2 of the gravure form cylinder 1, with the chamber 3 defining an interior space 4 with a circular cross-section. The interior space 4 is formed by a chamber body 5, a blade holder 6, a working blade 7, and a closing blade 8, and it opens toward the gravure form cylinder 1. On its end face, the interior space 4 is closed off by side walls 9, 10 (FIG. 4). In the example shown, the side walls 9, 10 are part of the chamber body 5. However, the sidewalls call also be, for example, formed by side parts connected to the end faces of the chamber body 5. The side walls 9, 10 contain a fluid inlet 11 and a fluid outlet 12 located opposite one another concentric to the interior space 4 of the chamber 3.

Figure 2:
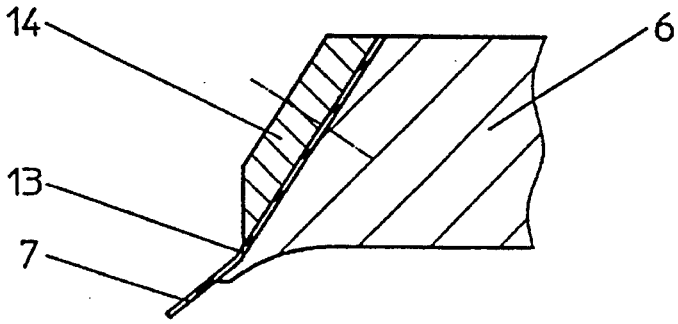
FIG. 2 is detail Z of FIG. 1.

The working blade 7 is positioned negatively on the gravure form cylinder 1 and is clamped for this purpose in the blade holder 6. The blade holder 6 contains a concavely angled seating surface 13 (FIG. 2). When the working blade 7 is drawn into this depression of the seating surface upon tightening with a strip 14, the working blade buckles along its entire length and becomes stiff. On the inlet side, the interior space 4 is closed by the closing blade 8 positioned positively on the gravure form cylinder 1. The closing blade 8 is held in place by means of a strip 16 screwed to the chamber body 5. In certain cases, e.g., when there is low inner pressure in the chamber 3 and more highly viscous inks are used, a closing strip located at a slight distance from the gravure form cylinder 1 may be used instead of the closing blade 8. A closing strip of this sort can also be designed as part of the chamber body 5.

Figure 3:
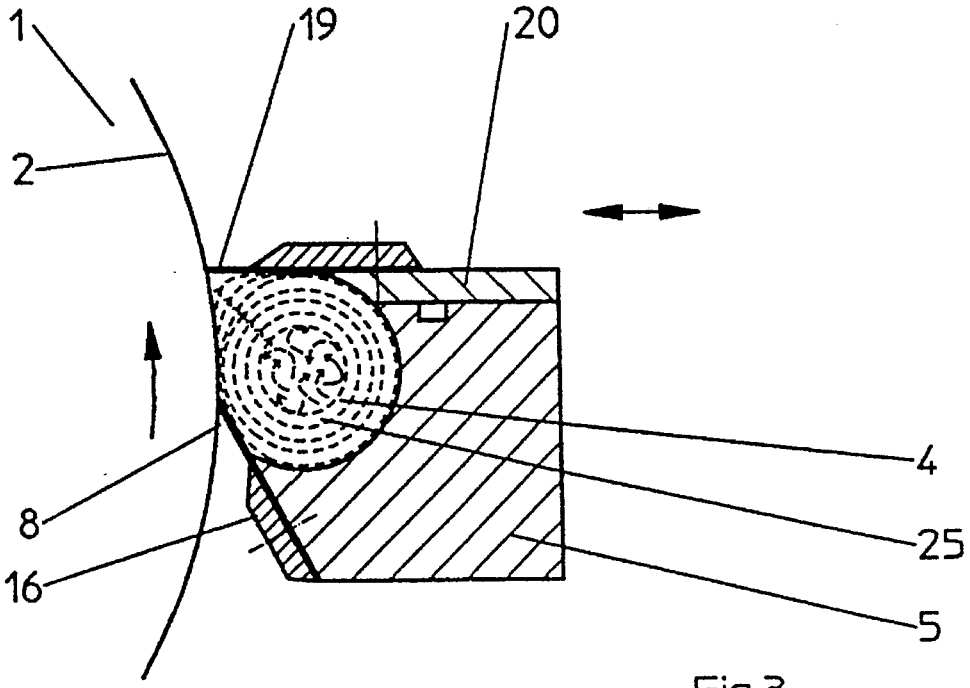
FIG. 3 is a view as seen in FIG. 1 with a positively positioned working blade.
Figure 5:
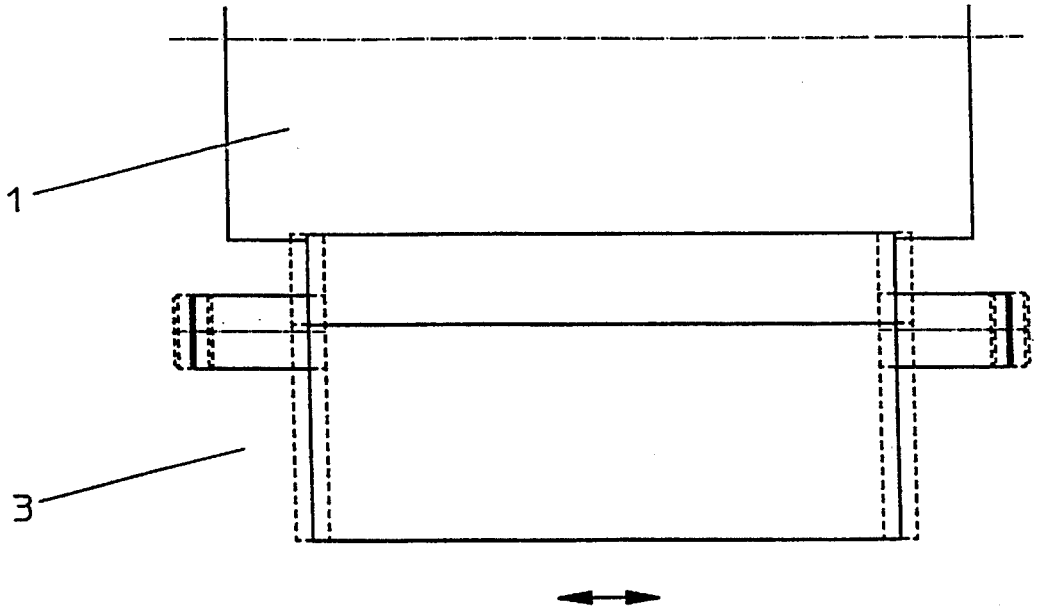
FIGS. 5 and 6 show the device of FIG. 1 in a top view.
Figure 6:
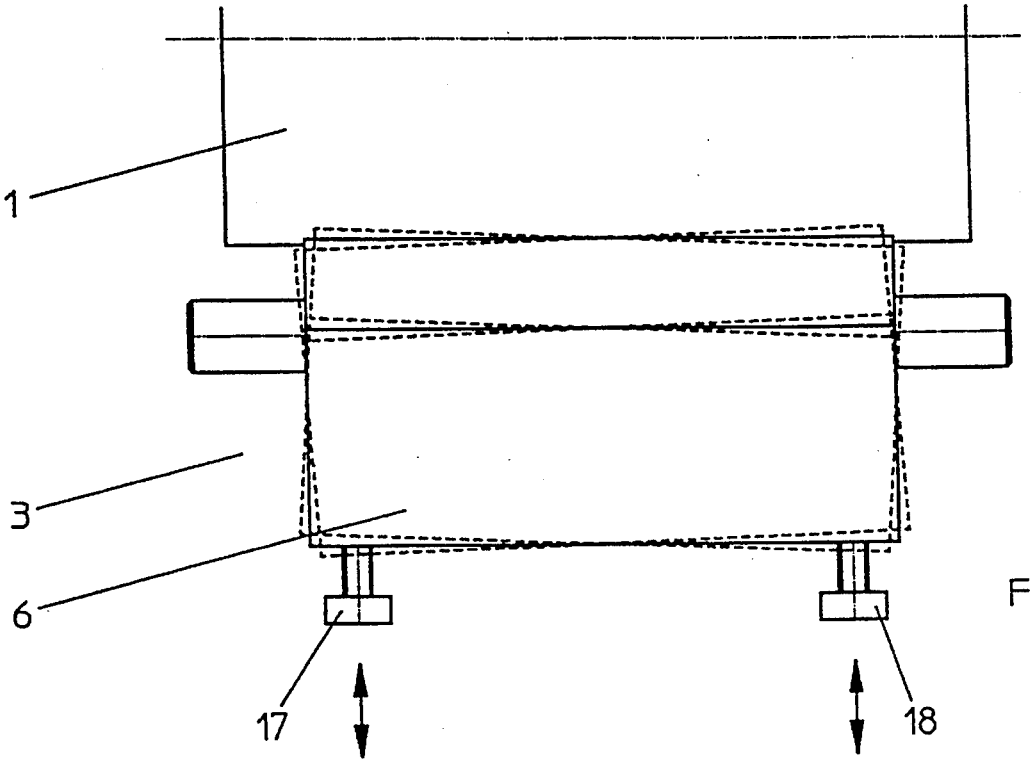

The chamber 3 is advantageously located in the longitudinal direction of the gravure form cylinder 1 in a changeable manner. The travers motion is shown schematically in FIG. 5. In addition, the blade holder 6 is swingably and slidably adjustable in the direction of the gravure form cylinder 1. The possible movements are shown in FIG. 6. Furthermore, the blade holder 6 positioned negatively on the working blade 7 can be exchanged for a blade holder 20 positioned positively on the gravure form cylinder 1. Such a combination of the chamber body 5 with the blade holder 20 is shown in FIG. 3.

Figure 7:
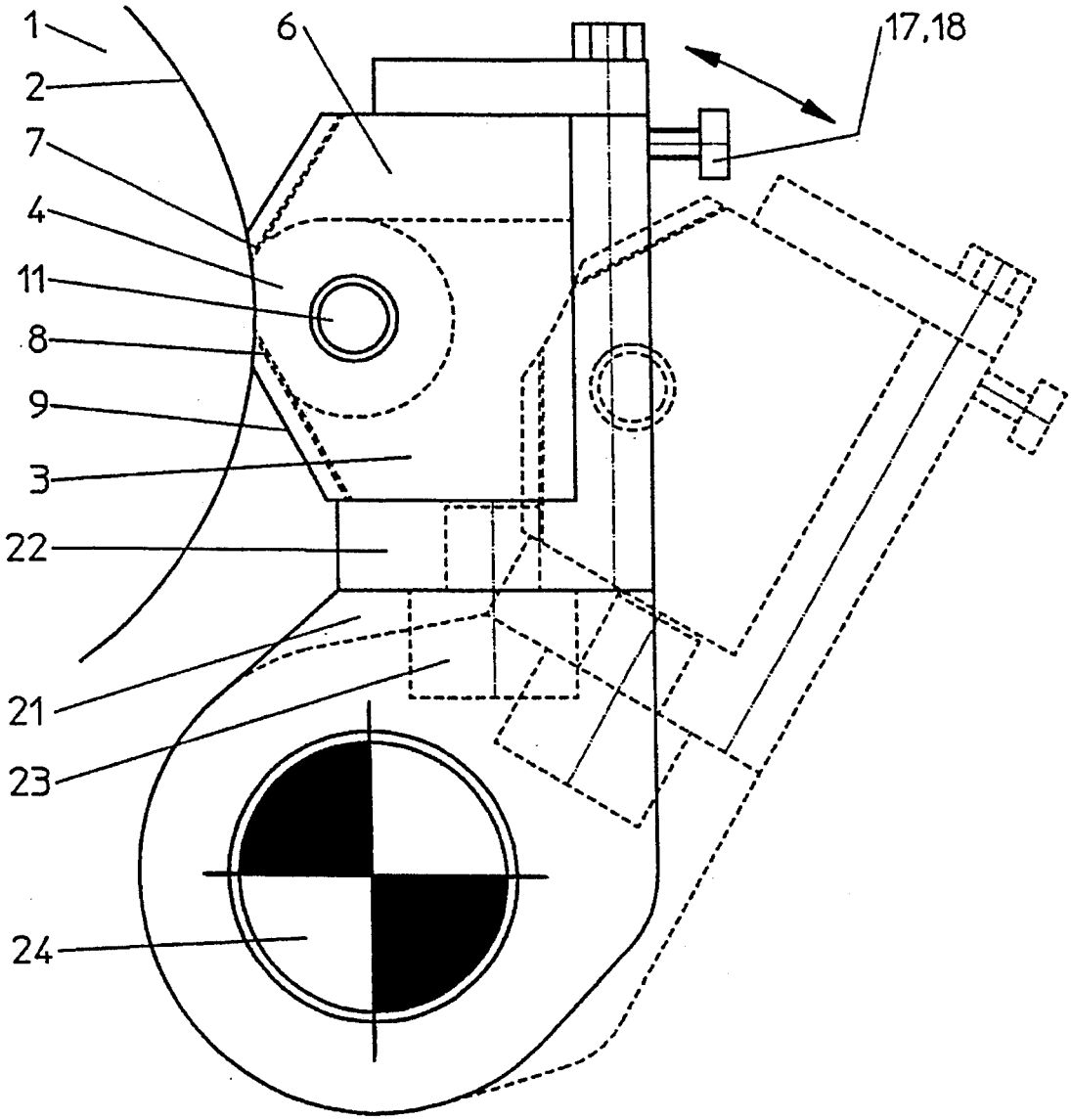
FIG. 7 shows the device of FIG. 1, attached to a swingable blade table.

The chamber 3 is advantageously attached to a blade table 21 (FIG. 7). For this purpose, a U-shaped receptacle 22, in which the chamber 3 sits, is screwed onto the blade table 21. Working cylinders 23, which are let into the blade table 21 and distributed along its length, clamp the chamber 3 against a yoke of the receptacle 22. Furthermore, the positioning screws 17, 18, which serve to adjust the blade holder 6, are screwed into the receptacle 22. In order to reposition and adjust the working blade 6, the working cylinders 23 are relaxed to a pilot pressure, after which the blade holder 6 can be slid and swung by appropriate operation of positioning screws 17, 18. After this, the working cylinders 23 are again subjected to full pressure.

The blade table 21 is supported on a stationary round traverse 24. For the purpose of changing the chamber, the chamber is advantageously moved together with the blade table 21 on the round traverse 24. In addition, the blade table 21 can be rotated on the round traverse 24 so that the chamber 3 call be swung along with it away from the gravure form cylinder 1. The swinging is advantageously carried out by means of a working cylinder (not depicted) connected to the blade table 21 and resting in a hinged fashion on the frame.

For the purpose of inking the gravure form cylinder 1, the chamber 3 is swung up to the cylinder 1. An ink pump P, which delivers ink into the interior space 4, is connected to the fluid inlet 11. The arrow in FIG. 4 is meant to symbolize this. The chamber 3 is operated with an interior pressure between 0.1 and 1.5 bar. Excessive delivered ink is discharged at the fluid outlet 12 and returned to the ink container. The ink needed for filling the cups is supplied once. By means of a delivery quantity that is higher, compared to this consumption, pressure is built up in the chamber 3, and good intermixing and renewal of the ink in the chamber is achieved, along with the discharge of any air present.

The ink in the interior space 4 of the chamber 3 is carried along by adhesion on the surface of the mantle 2 of the rotating gravure form cylinder 1 and is set into rotation, so that in the interior space 4 a rotating fluid roller 25 is formed. The latter reliably fills the cups of the gravure form cylinder 1, which are subsequently wiped off by the working blade 7. During inking, the chamber 3 on the gravure form cylinder 1 changes. However, this is not a condition for the use of the invention.

The invention has been described in reference to the example of inking a gravure form cylinder. The device could also be used, for example, to ink the screen rollers of short inking units. The device can also be used in processing highly water soluble gravure inks. The use of the device is not limited to inking processes. The device is, for example, also advantageous for filling the screen rollers of varnishing units or the damping unit of rollers which feed printing machines. Furthermore, the use of chambers which contain no blades is also possible.

The invention is not limited by the embodiments described above which are presented as examples only but can be modified in various ways within the scope of protection defined by the appended patent claims.

I claim:

1. A process for filling depressions in a cylindrical surface of a rotating, cylindrical body with a fluid, comprising the steps of: providing a chamber having an obstruction-free interior space with a circular cross-section, a fluid inlet and fluid outlet concentric to the interior space, as well as an open portion; placing the open portion of the chamber against the rotating cylindrical body; and supplying fluid to the chamber via the fluid inlet and carrying off fluid via the fluid outlet so that an overpressure is created in the interior space, whereby rotation of the cylindrical body creates a rotating fluid roller within the interior space that is parallel to the cylindrical body and which fills the depressions while a horizontal fluid flow is maintained at the center of the fluid roller.

2. A device for filling depressions in a cylindrical surface of a rotating cylindrical body having a mantle, with a fluid comprising: a chamber member having an opening therein directed toward the cylindrical body, the chamber member being locatable along the mantle of the cylindrical body, and defining an obstruction-free interior space with a circular cross-section, and the chamber member including a chamber body adapted to define a portion of the interior space; oppositely arranged sidewalls that close end faces of the interior space; an ink inlet in one of the sidewalls; and an ink outlet in another of the sidewalls, the ink inlet and the ink outlet being concentric to the interior space, whereby rotation of the cylindrical body creates a fluid roller which rotates in the interior space while a horizontal fluid flow is maintained at the center of the fluid roller.

3. A device as defined in claim 2, and further comprising a working blade arranged so as to close the interior space in the rotational direction of the cylindrical body, the working blade being positionable against the cylindrical body.

4. A device as defined in claim 3, wherein the working blade is arranged on the chamber member so as to be postioned one of negatively and positively relative to the cylindrical body.

5. A device as defined in claim 3, and further comprising a blade holder connected to the chamber body for holding the working blade.

6. A device as claimed in claim 5, and further comprising means for exchangeabley connecting the blade holder to the chamber body to hold the working blade one of positively and negatively.

7. A device as defined in claim 5, wherein the blade holder is arranged and adapted to be swingable and slidably adjustable relative to the cylindrical body.

8. A device as defined in claim 5, wherein the blade holder has a non-planar seating surface to which the working blade is attached, whereby the working blade is bent and stiffened.

9. A device as defined in claim 2, and further comprising a closing strip member arranged to close the interior space opposite to the rotating direction of the cylindrical body.

10. A device as defined in claim 9, wherein the closing member is arranged and adapted to be at a distance from the cylindrical body.

11. A device as defined in claim 9, wherein the closing member is a closing blade positionable positively against the cylindrical body.

12. A device as defined in claim 2, and further comprising a blade table attached to the chamber member so that the blade table and the chamber member are swingable toward and away from the cylindrical body.

13. A device as defined in claim 12, wherein the blade table has a U-shaped receptacle with a yoke, and further comprising working cylinder means for holding the chamber member against the yoke of the receptacle.

14. A device as defined in claim 12, and further comprising a stationary traverse member parallel to the cylindrical body, the blade table being movably mounted on the traverse member so that the chamber member is movable along the mantle of the cylindrical body.

15. A device as defined in claim 2, and further comprising pump means for producing an overpressure in a range from 0.1–1.5 bar in the interior space of the chamber member, the pump means being attached to the fluid inlet.

* * * * *